United States Patent [19]

Ekkelboom

[11] Patent Number: 4,703,672

[45] Date of Patent: Nov. 3, 1987

[54] METHOD OF MANUFACTURING A DRAWING DIE

[75] Inventor: Tjepke H. Ekkelboom, Eindhoven, Netherlands

[73] Assignee: U.S. Philips Corporation, New York, N.Y.

[21] Appl. No.: 874,906

[22] Filed: Jun. 6, 1986

[30] Foreign Application Priority Data

Jun. 21, 1985 [NL] Netherlands ..... 8501788

[51] Int. Cl.[4] ..... B23P 15/24; B21C 3/02

[52] U.S. Cl. ..... 76/107 A

[58] Field of Search ..... 76/107 R, 107 A, 101 R, 76/DIG. 12

[56] References Cited

U.S. PATENT DOCUMENTS 4,392,397 7/1983 Engelfriet ..... 76/107 A

*Primary Examiner*—Roscoe V. Parker

*Attorney, Agent, or Firm*—Norman N. Spain

[57] ABSTRACT

A method of manufacturing a drawing die, in which a core of, for example, natural or synthetic diamond is clamped in the cavity intended for this purpose by deforming a tube which is made of, for example, a copper alloy to an annulus, the core being properly centered through the use of a rod-like member by means of which the core is pressed against the bottom of the cavity by a rod-like member having a pressure surface parallel to the bottom of the cavity during the deformation of the cylinder; in this way tilting of the core is precluded and it is not covered with material of the annulus in places where this is undesirable.

6 Claims, 9 Drawing Figures

METHOD OF MANUFACTURING A DRAWING DIE

BACKGROUND OF THE INVENTION

The invention relates to a method for the manufacture of a drawing die, in which a tube of a metal or a metal alloy is placed in a cavity in one side of a metal housing, a core is placed inside the tube, which has an internal diameter larger than the maximum dimension of the core, in a direction perpendicular to the axis of the tube, and the tube is deformed to reduce its axial dimension and its internal diameter to an extent such that an annulus is formed which grips the core and is a tight fit in the cavity of the metal housing, after which a drawing passage is provided in the core.

Drawing dies manufactured by such a method may be used, for example, for drawing wires.

A method as described above is known from U.S. Pat. No. 4,392,397, in which a strong temperature-resistant drawing die is obtained by clamping a metal annulus around the core by means of cold pressing. Unlike other known methods of manufacturing a drawing die (such as, embedding the core in bronze, or sintering or pressing into a metal powder) to bubbles and inclusions are formed. Moreover, the annulus subjects the core to an omnilaterial compressive stress which reduces the susceptibility of the core material to tearing.

However, this known method has a number of drawbacks which very much limit its practical use. Generally, the core will not remain level during the cold pressing of the annulus; it will e.g. tilt slightly which is impermissible in the case of a drawing die. Moreover, the annulus is deformed to such an extent that the upper side and the lower side of the core are partly covered with metal of the annulus. An additional treatment of the drawing die is necessary to clear the surfaces of the core. Furthermore, it has been found that the applicability of the method of this patent is limited if the core has a non-circular circumference.

SUMMARY OF THE INVENTION

It is an object of the invention to provide a method for the manufacture of a drawing die, in which the advantages of that shown in the above-described United States patent are retained and the drawbacks are obviated. A further object of the invention is to provide a method in which cores with any circumferential profile can be applied. Yet a further object of the invention is to provide a method by means of which the core can be properly centered in an easy manner and in which, if the properly centered core of a drawing die is subject to wear, the diameter of the drawing passage can be enlarged several times, thus making it possible to use the die for drawing wires of a larger diameter.

These objects are accomplished by a method as described in the opening paragraph, which is further characterized in that the upper and lower end faces of the core are parallel, the cavity in the metal housing has a level bottom on which the core is located, and that during the deformation of the tube the core is pressed to the bottom of the cavity by a cylindrical rod-like member having a pressure surface which is parallel to the bottom of the cavity of the metal housing, which punch fits accurately in the tube and has a diameter which is equal to or larger than said maximum dimension of the core.

Because of the fact that the core is pressed against the bottom of the cavity with a punch and its upper and lower surfaces are parallel, tilting of the core is avoided. This also provides proper centering of the core, so that it is not necessary to form (for example) a recess having the same peripheral profile as the core in the bottom of the cavity in the metal housing. By pressing the core with a rod-like member of at least the same size, both the upper and the lower surface of the core remain free of metal from the deformed tube and, consequently, no after-treatment is required to make the core accessible again. The core may have any required circumferential shape for example circular or hexagonal, the latter being quite common for some of the commercially available synthetic diamonds. The method of the invention has the additional advantage that it can be carried out at a low temperature. Thus, the drawing die is not subjected to temperature changes, which is advantageous especially in the case of synthetic diamond. The drawing dies manufactured by means of the method in accordance with the invention can resist a temperature of up to 600° C., which temperature may occur during the drawing of, for example, steel wire.

DETAILED DESCRIPTION OF THE INVENTION

Figure 1A:
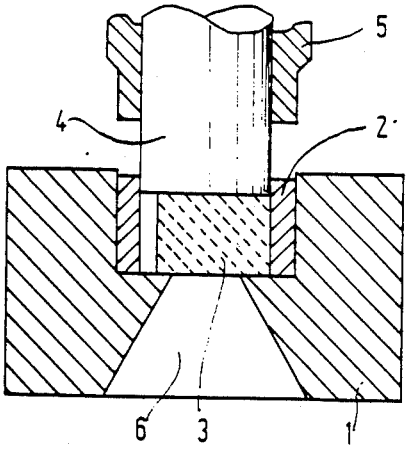
FIGS. 1A–B is a schematic view of an embodiment of the method in accordance with the invention.

The invention will now be described in greater detail by reference to the drawing as to the embodiments which follow.

The core as used in the method in accordance with the invention, may comprise commonly used materials such as natural or synthetic diamond, polycrystalline diamond, hard metal (for example WC), ceramic materials (for example silicon nitride), polycrystalline cubic boron nitride or combinations thereof. Polycrystalline diamond is commercially available under various designations, ("Compax"—General Electric Company, "Syndite"—De Beers Industrial Diamond Division). Polycrystalline cubic boron nitride is also commercially available ("Amborite"—De Beers Industrial Diamond Division, "Borazon CBN"—General Electric Company).

Preferably, the metal housing consists of a corrosion resistant, workable alloy such as a ferritic chromium steel (for example AISI 430) or an austenitic chromium-nickel steel (for example AISI 302 or 304). The metal housing is provided with an essentially cylindrical cavity in which the tube can be fitted.

The drawing passage in the core can be formed in a manner which is customary in this technology, for example, by means of laser drilling or spark erosion, either before or after the core has been secured in the metal housing.

To avoid the development of a large pressure-gradient in the tube, preferably a tube having a small axial dimension is used, e.g. not more than 3 mm. If a larger axial dimension is necessary, it is preferable that at least two tubes are deformed in succession into an annulus around the core in the cavity of the metal housing.

In order to let air escape during the deformation of the tube, it is advantageous if, in its side opposite that in which the cavity is formed, the metal housing is provided with a further opening which opens into the cavity. The further opening which is, for example conically shaped, is needed later to allow access to the core of the drawing die. By forming the further opening before the core is placed, the opening acquires another useful function.

Prior to deformation the tube may project beyond the cavity of the metal housing. After the deformation process, the space between the core and the metal housing must be filled up. However, the best results are obtained if prior to the deformation process the tube(s) does (do) not project beyond the side of the metal housing in which the cavity is formed. In general, it will be necessary to turn material from this side of the metal housing until it is flush with the adjoining surface of the core.

In an alternative embodiment of the method in accordance with the invention, a guide ring having an inside diameter equal to the diameter of the cavity is placed during the deformation step on the metal housing around the cavity, such that prior to deformation the tube(s) does (do) not project beyond the guide ring. If the tube(s) and the guide ring are of a suitable axial dimension, the cylinder(s) will after deformation fill up the space between the core and the metal housing.

Suitable materials for the manufacture of the hollow cylinder are, for example, aluminum alloys and copper alloys. In a preferred embodiment of the method in accordance with the invention, the tube(s) is (are) formed from a copper alloy comprising between 0.3 and 1.2% by weight of chromium, with the remainder copper. This material is stable up to 500° C. and up to this temperature it has a coefficient of expansion which is close to that of the materials used for the metal housing. As described in the above-mentioned United States Patent, the deformation leads to an increased elastic limit of this material and consequently to a higher strength of the drawing die. However, within the scope of the invention, other suitable materials which are adapted to the requirements may be used. For example, heat conduction is an important factor therein owing to the high temperatures (up to 600° C.) which may develop during, for example, drawing of steel wire or tungsten wire.

EMBODIMENT 1

FIG. 1A is a sectional view of a metal housing 1 having in its upper side a cylindrical cavity in which a tube 2 is placed. The metal housing 1 consists of ferritic chromium steel (AISI 430), the tube 2 consists of a copper alloy comprising 0.6% by weight of chromium, with the remainder copper. The inside diameter of the tube 2 is 5.5 mm, the outside diameter is 8.5 mm. A core 3 of polycrystalline diamond "Syndite"-De Beers Industrial Diamond Division) having a diameter of 4.5 mm is placed inside the tube 2. The core 3 has parallel upper and lower flat end faces; the other circumference of the core may have any shape, for example circular, hexagonal or irregular. The core 3 is pressed against the bottom of the cavity in a direction parallel to the axis of the tube 2 by means of a cylindrical rod-like member 4 with a force of 0.1 to 0.5N. The rod-like member 4 fits accurately in the tube 2 and has a pressure surface which is parallel to the bottom of the cavity of the housing. In the metal housing 1 there is also provided a conical opening 6 which at its narrower end opens into the cavity in which the tube 2 and the core 3 are placed, the tube and the core being supported on the level bottom of this opening.

Figure 1B:
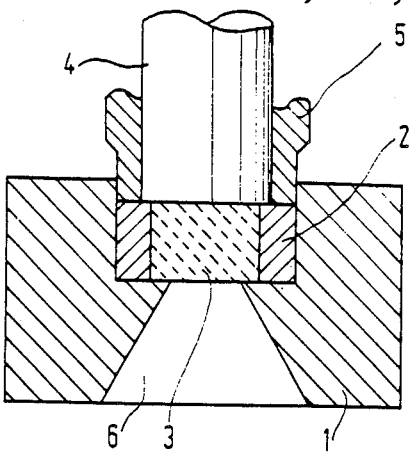

By means of a simple hydraulic press, of which only a part of a pressing tool 5 is shown in the Figure, the tube 2 is pressed and deformed, see FIG. 1B, into an annulus which circumferentially grips the core 3. The pressure exerted on the pressing tool 5 during the deformation process is 150N. After removal of the rod-like member 4 and the pressing tool 5, material is turned from the upper surface of the metal housing 1 until this surface is flush with the upper surface of the core 3.

Figure 2A:
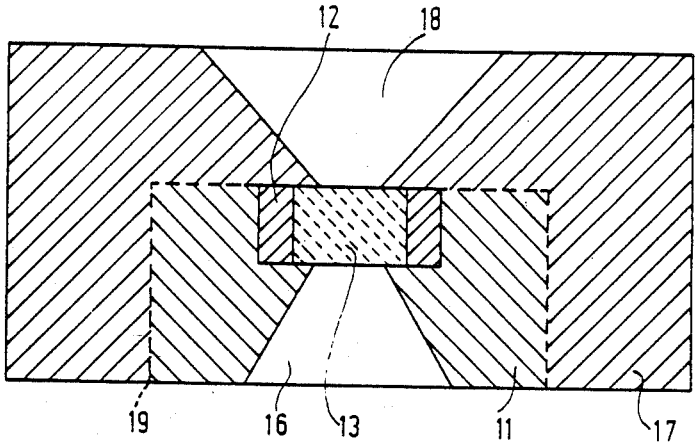
FIGS. 2A–B is a schematic sectional view of a mounted drawing die without and with a drawing passage, FIGS. 3A–C and FIGS. 4A–B schematically show alternative embodiments of the method in accordance with the invention.

FIG. 2A shows a metal housing 11 after it has been press-fitted into an outer ring 17, for example by applying a pressure of up to 50N. This outer ring 17 is provided with a conical opening 18. The outer ring 17 consists of ferritic chromium steel (AISI 430), but it may also consist of other materials which can suitably be used for drawing dies. If necessary, the metal housing 11 is secured to the outer ring 17 by argon arc-welding at a number of points (for example 3) or around the entire circumference 19 of the housing 11., after which the outer ring may be treated further. The annulus 12 and the core 13 are firmly secured, the latter being accurately centred. The core 13 is accessible on both sides through the conical openings 16 and 18.

Figure 2B:
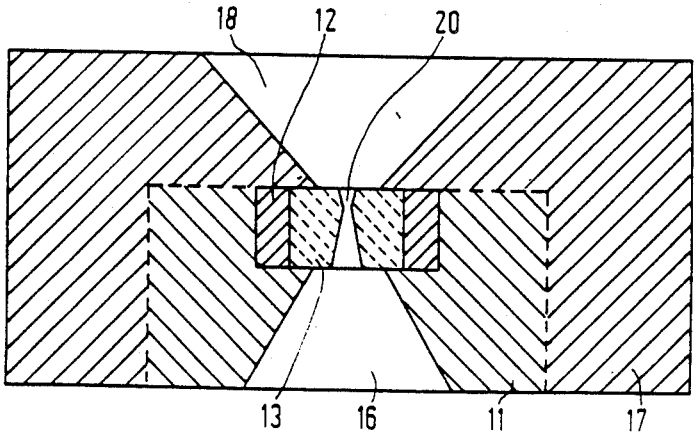

FIG. 2B shows a drawing die manufactured in accordance with this method, in which a drawing passage 20 is provided in a manner which is customary in this technology (for example by laser drilling or spark erosion). However, within the scope of the invention it is also possible to use a core 13 which has been provided with a drawing passage 20 prior to applying the method described herein.

EMBODIMENT 2

The materials used in this embodiment are the same as in embodiment 1.

Figure 3A:
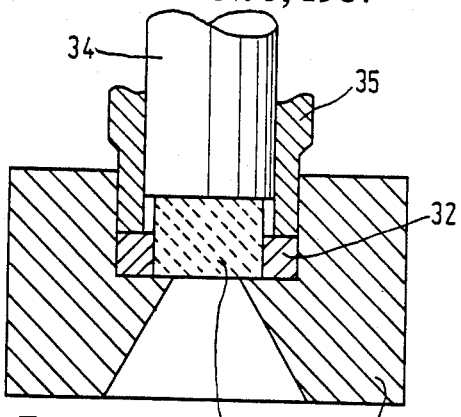

FIG. 3A shows a metal housing 31 with a cavity containing an annulus 32, which is formed by deformation of a tube in the above-described manner, and a centered and clamped core 33, see embodiment 1. The axial dimension of the tube prior to deformation is chosen so that the tube will undergo a deformation of about 20% before the resulting annulus grips the core 33. If the required axial dimension of the tube 32 after deformation is more than 3 mm, it is preferable to use a plurality of tubes, each of which has an axial dimension of between 2 and 3 mm and which will be individually deformed.

Figure 3B:
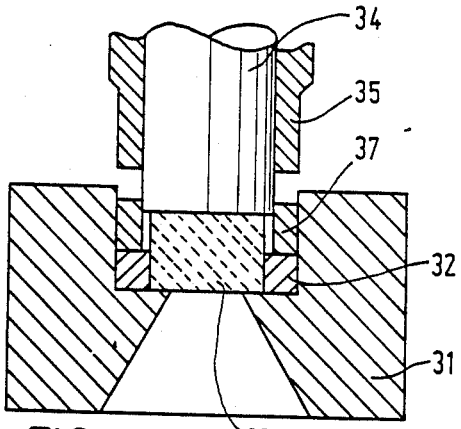
Figure 3C:
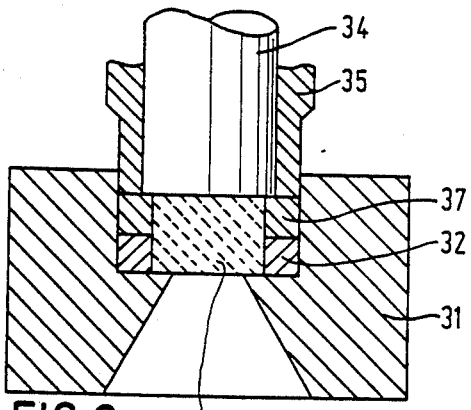

FIG. 3B shows the next step in the method according to the present embodiment in which a second tube 37 is placed on the annulus 32. The tube 37 also consists of the above-mentioned copper alloy comprising 0.6% by weight of chromium. The punch 34 is brought into position again, after which by applying a force of 150N to the pressing tool 35 the tube 37 is deformed into an annulus, see FIG. 3C.

The intermediate product thus formed is subsequently worked into a drawing die in the way described in embodiment 1. An additional advantage of this embodiment of the method according to the invention, in which the annuli 32 and 37 are deformed one after the other, is that in order to prevent the tubes 32 and 37 from projecting beyond the housing 31, the housing 31 only needs a small additional height and only a small portion of the housing 31 need be turned off.

EMBODIMENT 3

The materials used in this embodiment are the same as in embodiment 1.

Figure 4A:
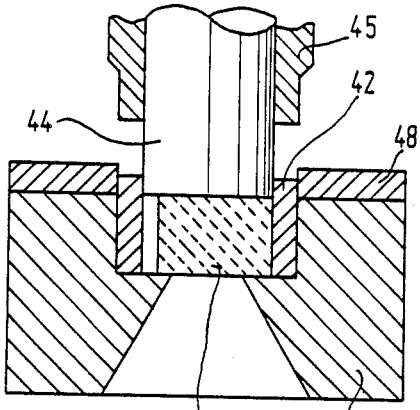
Figure 4B:
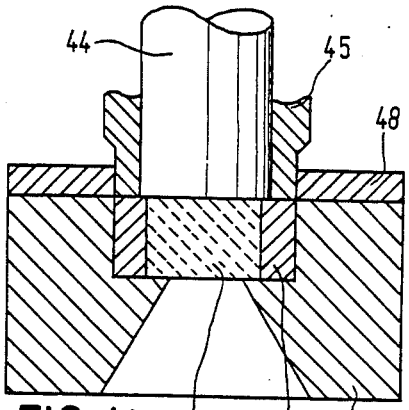

FIG. 4A shows a metal housing 41 with a cavity containing a tube 42 and a core 43. The tube 42 projects beyond the housing 41. A guide ring 48 is placed on the housing 41, around the projecting portion of the tube 42, which ring is made of, for example, the same material as the housing 41. The tube 42 does not project beyond the ring 48. The core 43 is pressed, in the axial direction against the bottom of the cavity by means of a punch 44, after which the tube 42 is deformed by means of a pressing tool 45. The annulus 42 thus formed circumferentially grips the core 43 and is a tight fit in the cavity of the metal housing 41. The core 43 is thereby centered (see FIG. 4B).

Subsequently, the punch 44, the pressing tool 45 and the ring 48 are removed. When the intermediate product is further worked into a drawing die as described in embodiment 1, it is no longer necessary to turn off the surface of the metal housing 41 provided that the dimensions of the tube 42, of the core 43 and of the central opening in the housing are such that after the deformation process the upper surfaces of the annulus 42, of the core 43 and of the housing 41 lie in one plane.

Wire-drawing experiments performed with tungsten wires, copper wires and steel wires have shown that the drawing dies obtained with each of the above-described embodiments of the method in accordance with the invention has a sufficiently long service life.

What is claimed is:

1. A method of manufacturing a drawing die, said method comprising:

(a) providing a cavity in one side of a metal housing, the bottom of said cavity being level;

(b) placing a tube formed of a metal or metal alloy inside said cavity the axis of said tube corresponding essentially to the axis of said cavity;

(c) placing a core inside said tube, said core having a maximum dimension in a direction perpendicular to the axis of the tube smaller than the internal diameter of the tube;

(d) pressing the core against the bottom of the cavity by a rod-like member, the pressure surface of which rod-like member is parallel to the bottom of the cavity and which rod-like member fits accurately in the tube and has a diameter which is at least equal to that of said maximum dimension of the core;

(e) applying to the tube a force deforming the tube to thereby reduce its external axial dimension and its internal diameter to an extent such that an annulus is formed which grips the core and provides a tight fit for the core in the cavity; and (f) providing a drawing passage in the core.

2. A method as claimed in claim 1, characterized in that at least two tubes are deformed in succession into an annulus around the core in the cavity of the metal housing.

3. A method as claimed in claim 1, characterized in that in its side opposite that in which the cavity is formed the metal housing is provided with a further opening which opens into said cavity.

4. A method as claimed in claim 1, characterized in that prior to the deformation the tube(s) does not project beyond the side of the metal housing in which said cavity is formed.

5. A method as claimed in claim 1, characterized in that during the deformation process a guide ring is placed on the metal housing around the cavity, which ring has an inside diameter equal to the diameter of the cavity, such that prior to deformation the tube(s) does not project beyond the guide ring.

6. A method as claimed in claim 1, characterized in that the tube is formed from a copper alloy comprising 0.3 to 1.2% by weight of chromium, with the remainder copper.

* * * * *